United States Patent [19]

Johnson

[11] 4,274,270

[45] Jun. 23, 1981

[54] APPARATUS FOR STRETCHING AN ANIMAL HIDE

[76] Inventor: Thomas H. Johnson, Rte. 3, Anderson, Mo. 64831

[21] Appl. No.: 80,255

[22] Filed: Oct. 1, 1979

[51] Int. Cl.[3] ..... C14B 1/26; D06C 3/08

[52] U.S. Cl. ..... 69/19.3; 38/102.4

[58] Field of Search ..... 69/19, 19.1, 19.3; 38/102.3, 102.4

[56] References Cited

U.S. PATENT DOCUMENTS

| | | | |
|---|---|---|---|
| 1,268,610 | 6/1918 | Prange et al. | 69/19.1 |
| 1,338,050 | 4/1920 | Tucker | 69/19.3 |
| 2,185,441 | 1/1940 | Jureczki | 69/19.3 |
| 2,594,902 | 4/1952 | Frazier | 69/19.1 |

*Primary Examiner*—Patrick D. Lawson
*Attorney, Agent, or Firm*—Head & Johnson

[57] ABSTRACT

An apparatus for stretching an animal hide, such as a beaver hide, to allow the hide to dry, the stretcher including a frame of four tubular members of equal length secured at a common point and extending in a common plane and spaced about 90° from each other, a stretcher member for each of the frame tubular members, each stretcher member extending radially from the frame, each stretcher member having an arcuate outer circumferential portion, a plurality of spaced prongs extending from each of the arcuate portions adaptable to engage the periphery of an animal hide, and means of radially extending outwardly the stretcher members so that the hide is stretched and retained in a stretched position while drying.

4 Claims, 2 Drawing Figures

APPARATUS FOR STRETCHING AN ANIMAL HIDE

BACKGROUND OF THE INVENTION

1. Field of the Invention

This invention relates to the field of pelt or hide stretchers, that is, apparatus used for stretching a hide after it is freshly removed from an animal to permit the hide to dry. The hide thereafter can be processed for use in making coats and other items of fur.

2. Description of the Prior Art

Various kinds of hide stretchers have been used since the beginning of recorded history for the use in curing hides. They are typically made of wood and usually of a flat board which is configured so that the hide can be stretched over it. With some animals it is possible to remove the hide in the form of a closed sleeve in which case the hide can be stretched over a board with the hide extending on both sides of the board. Hide stretchers have been made out of tree limbs. More recent efforts to provide improved hide stretchers are shown in the following U.S. Pat. Nos.:

1,632,551
2,185,441
2,290,457
2,594,902
3,313,038
3,407,634.

All of the known methods of stretching hides work satisfactorily. One problem exists, however, with the hides of a certain type of animals, such as beaver, wherein the hide is typically of a substantially circular pattern. It is difficult to arrange such hides on the known type stretchers.

It is therefore an object of this invention to provide an improved device for stretching hides.

More particularly, an object of this invention is to provide a device for stretching a hide, particularly that of a substantially circular configuration, in which the stretcher may be extended so as to apply equal stretching force around the full perimeter of the hide.

These general objects, as well as other and more specific objects of the invention, will be fulfilled in the following description and claims, taken in conjunction with the attached drawings.

SUMMARY OF THE INVENTION

A hide stretcher is formed of a frame which, in the preferred embodiment, is formed of four tubular members, each having an inner end and an outer end. The inner end of each of the tubular members is secured together at a common point and the tubular members extend from this common point in a common plane. The tubular members are spaced 90° apart and each has a threaded opening adjacent the outer end perpendicular to the tubular axis. Four stretcher members are provided, each having a radially extending leg portion which is telescopically received in one of the frame tubular members. Each of the stretcher members has an arcuate outer circumferential portion which lies in the same common plane as the frame. Affixed to the stretcher circumferential portions are a plurality of spaced apart prongs adapted to engage the periphery of an animal hide. A thumb screw is placed in the threaded opening in each of the tubular members so that the stretcher members may be telescopically adjusted whereby after the hide is attached to the prongs the stretcher members may be extended out to apply equal stretching force around the full perimeter of the hide.

DETAILED DESCRIPTION

Figure 1:
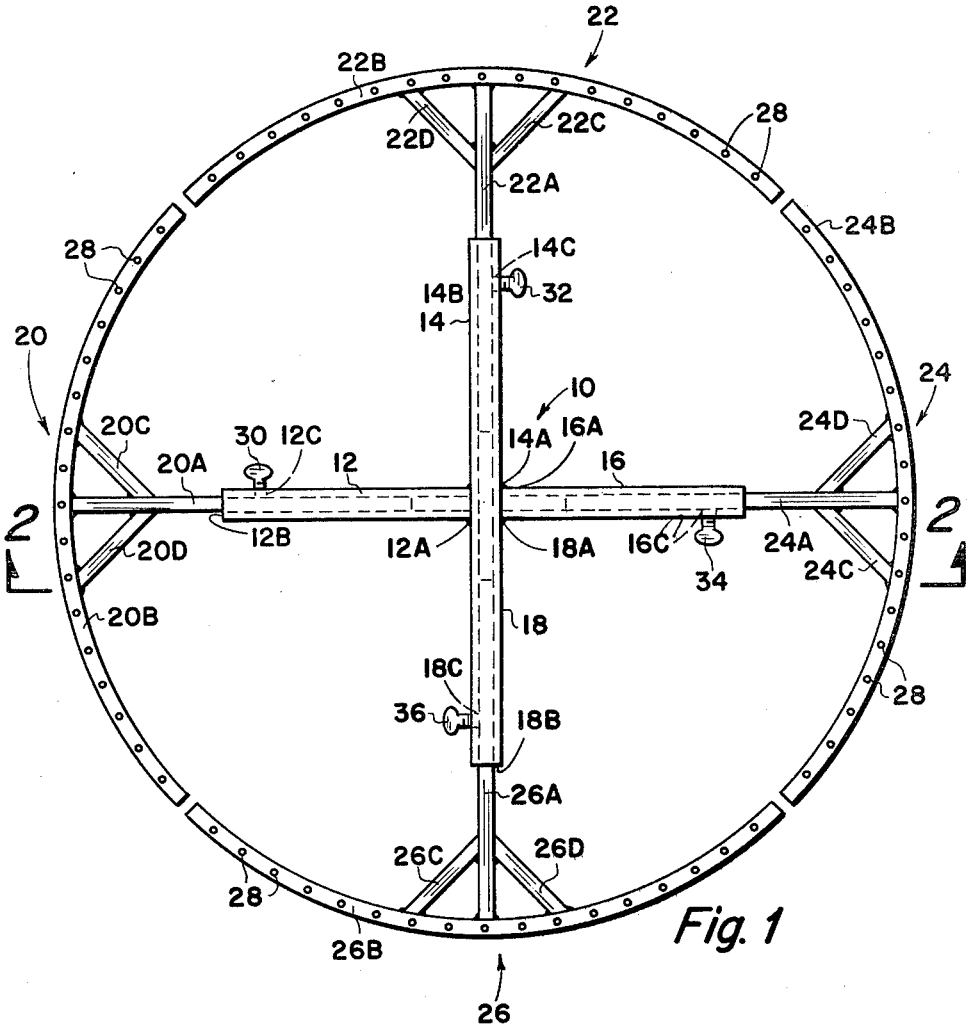
FIG. 1 is a plan view of a preferred embodiment of the stretcher of this invention.
Figure 2:
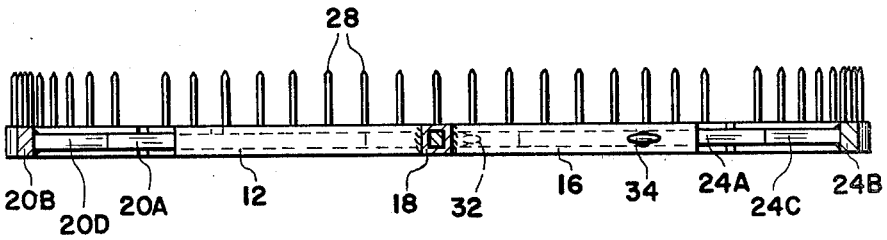
FIG. 2 is a cross-sectional view taken along the line 2—2 of FIG. 1.

Referring to the drawings, the structure includes a frame generally indicated by the numeral 10. The frame is formed of a plurality of tubular members, four members being illustrated, the tubular members being indicated by the numerals 12 through 18. Each of the tubular members has an inner end indicated by the letter A and an outer end by the letter B, that is, the inner end of the tubular member 12 is 12A and the outer end is 12B, etc. The inner ends 12A, 14A, 16A, and 18A are joined together at a common point and the tubular members extend outwardly from the common point in a common plane and are spaced equally apart. In the arrangement of FIG. 1 wherein four tubular members are employed, the members are spaced 90° from adjacent members.

In the illustration, tubular members 14 and 18 are formed as a single tube instead of separate tubes with the tubular members 12 and 16 welded to it. It can be seen that the frame may be constructed of three tubular members spaced 120° apart rather than four spaced at 90° as in FIG. 1, and may equally as well be formed of five or more members. The illustrated arrangement wherein the frame consists of four tubular members is considered ideal although the invention may be practiced with three or five members equally spaced. Less than three members is not considered desirable, and more than five or six, while functioning satisfactorily, are undesirable from the standpoint of economics of construction.

Four stretcher members, each indicated generally by the numerals 20, 22, 24, and 26 are employed. Each stretcher member has an inwardly radially extending leg portion identified by the letter A. The leg portions 20A, 22A, 24A, and 26A are each telescopically received within a frame tubular portion. In the preferred arrangement the stretcher leg portions are of square cross-sectional metal such as steel or aluminum.

Affixed to the outer ends of each of the stretcher member leg portions is an arcuate outer circumferential portion identified as numeral B, that is, 20B, 22B, 24B, and 26B. These arcuate outer portions are also preferably formed of square cross-sectional metal, although it can be seen that they can also be formed of rectangular or round cross-sectional metal. The arcuate portions are preferably formed in a manner and of a length so that in one adjustment of the stretchers, as shown in FIG. 1, the arcuate portions are segments of a circle. This is the configuration wherein the stretcher is to receive the smallest pelt for which the stretcher is sized.

To reinforce the attachment of the stretcher leg portions to the stretcher arcuate portions, angle braces identified by the letters C and D are employed, that is, for example, the angular braces for stretcher members 20 are identified as 20C and 20D. It can be seen that the arcuate outer portions may be reinforced to the stretcher member leg portions in a variety of ways.

A plurality of spaced apart prongs 28 extend from each of the stretcher member arcuate portions 20B, 22B, 24B, and 26B. In the illustrated arrangement the prongs extend upwardly, that is, perpendicular to the plane of frame 10 although it can be seen that the prongs could extend outwardly at an angle to the plane of the frame. The prongs are sharpened at the outer end so that an animal hide may be attached by forcing it down over the prongs adjacent the periphery of the hide. The prongs are preferably about $\frac{7}{8}''$ long although obviously the length may vary. The stretcher arcuate portion 20B, 22B, 24B, and 26B may be formed of metal, such as steel, approximately 5/16° square cross-section bent into the desired arcuate configuration.

Each of the frame tubular portions has a threaded opening adjacent the outer end, the openings being indicated by the letter C, that is, 12C, 14C, 16C, and 18C. The axis of each opening is perpendicular to the axis of its tubular frame member. Threadably positioned in opening 12C is a thumb screw 30. In like manner, a thumb screw 32 is threaded into tubular member 14; thumb screw 34 in tubular member 16; and thumb screw 36 in tubular member 18. The thumb screws 30–36 are used to adjustably position the stretcher members.

OPERATION

After a pelt has been removed from the animal, the stretcher members are adjusted by unloosening the thumb screws 30, 32, 34, and 36 and arranging the arcuate portions 20B, 22B, 24B, and 26B of the stretcher members so as to approximately define the circumferential shape of the pelt in its natural condition. The pelt then is affixed to the frame by forcing it over the pointed prongs 28 around the full periphery, the prong being inserted about ½ inch or so from the peripheral edge of the pelt. After the entire periphery of the pelt has been attached to the prongs 28 the stretcher members are outwardly extended to fully stretch the pelt, and the thumb screws 30, 32, 34, and 36 are tightened to retain the pelt in the stretched condition.

After the pelt has thoroughly dried, it can easily be removed from the frame and the frame reused for stretching other pelts.

Various size stretchers may be required for different size animals although each stretcher will accommodate a wide variety of sizes because of the ability of the stretcher members to extend radially outwardly from the frame.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. Apparatus for stretching an animal hide comprising:

a central frame in the form of a plurality of tubular members one end of each of which is affixed to a common central point;

a plurality of stretcher members extending radially from said frame, each stretcher member including a radially extending leg portion telescopically received in a said frame tubular member, and including means of retaining each said stretcher leg portion at selected telescopic positions, each stretcher member having an arcuate outer circumferential portion, the stretcher members and outer circumferential portions lying in a common plane; and a plurality of spaced prongs extending from each of said arcuate portions adaptable to engage an animal hide adjacent the periphery thereof.

2. An apparatus for stretching an animal skin according to claim 1 wherein each said frame tubular member has a threaded opening therein adjacent the outer end thereof and including a thumb nut in each threaded opening providing means of adjustably positioning said stretcher member.

3. Apparatus for stretching an animal hide comprising:

a frame of four tubular members of equal length, each having an inner end and an outer end and each secured at the inner end at a common point, the tubular members being in a common plane and spaced each 90° from adjacent members, each of the tubular members having a threaded opening therein adjacent the outer end;

four stretcher members each having an inwardly radially extending leg portion telescopically received in a said frame tubular portion, each stretcher member having an arcuate outer circumferential portion, the arcuate portions of the stretcher members lying in the common plane of said frame;

a plurality of spaced apart prongs extending from each of said stretcher member arcuate portions adaptable to engage an animal hide adjacent the periphery thereof; and a thumb screw in each of said tubular member threaded openings whereby the telescopic extension of the stretcher members may be adjusted.

4. Apparatus according to claim 3 wherein said plurality of prongs extend parallel to each other and perpendicular the plane of said frame.

* * * * *